US005158625A

United States Patent [19]

Lhote et al.

[11] Patent Number: 5,158,625

[45] Date of Patent: Oct. 27, 1992

[54] PROCESS AND APPARATUS FOR HEAT TREATING ARTICLES WHILE HARDENING IN GASEOUS MEDIUM

[75] Inventors: Benoit Lhote, Versailles; Philippe Queille, Viroflay; Jean-Pierre Zumbrunn, Claix; Eric Duchateau, Versailles, all of France

[73] Assignee: L'Air Liquide, Societe Anonyme Pour L'Etude Et L'Exploitation Des Procedes Georges Claude, Paris, France

[21] Appl. No.: 680,423

[22] Filed: Apr. 4, 1991

[30] Foreign Application Priority Data

Apr. 4, 1990 [FR] France ..... 90 04309

[51] Int. Cl.[5] ..... C21D 6/00; C21D 9/00

[52] U.S. Cl. ..... 148/625; 148/626; 148/633; 266/251; 266/254; 55/27; 55/68; 55/75

[58] Field of Search ..... 148/20.3, 16.7, 16, 148/13.2, 27; 266/250, 251, 252, 254, 253; 55/16, 23, 27, 68, 75, 73, 76, 158, 97

[56] References Cited

U.S. PATENT DOCUMENTS 2,450,081 9/1948 Burkhardt ..... 148/16.7
3,713,271 1/1973 Franz et al. ..... 55/16
4,675,030 6/1987 Garnecki et al. ..... 55/16
4,867,808 9/1989 Heilmann et al. ..... 148/20.3

FOREIGN PATENT DOCUMENTS 0266745 5/1988 European Pat. Off. .
3296820 12/1988 Japan ..... 55/16

*Primary Examiner*—R. Dean
*Assistant Examiner*—Sikyin Ip
*Attorney, Agent, or Firm*—Young & Thompson

[57] ABSTRACT

Process for heat treating articles by hardening them in a recirculating gas medium which is in contact with the treated articles, the hardening gas being cooled by means of a heat exchanger, of the type in which helium is used as hardening gas, and is stored under holding pressure in a buffer container, wherein at the end of a hardening operation, a helium load is extracted from the treatment enclosure, in final phase by means of pump until a primary vacuum is obtained, the extracted helium is brought to purifying pressure by means of a compressor associated to a mechanical filter, and the helium under purifying pressure is sent to a purifier in which impurities are removed, after which it is transferred, if desired, after recompression in the buffer container.

12 Claims, 2 Drawing Sheets

PROCESS AND APPARATUS FOR HEAT TREATING ARTICLES WHILE HARDENING IN GASEOUS MEDIUM

BACKGROUND THE INVENTION (a)Field of the Invention

The present invention concerns the heat treatment of articles including hardening thereof in a gaseous medium. In this type of technique, the hardening gas is caused to recirculate in contact with said treated articles, the hardening gas being cooled by means of an external heat exchanger.

(b)Description the Prior Art

Heat treatments carried out under vacuum or under a partial pressure of a neutral or cementation gas, in so called vacuum furnaces, often require a rapid cooling of the load at the end of the cycle. Hardening in gaseous medium constitutes an advantageous replacement solution over hardening in liquid medium, because it permits a better control of the kinetics of cooling, it minimizes deformations of the articles treated and takes away the cleaning operations required on the hardened articles, which are carried out in a salt bath or an oil bath.

In practice, furnaces operating under vacuum and adapted for gas hardening are provided with a powerful recirculating blower and the gas injected under pressure within the furnace is successively displaced through the load under the treatment. Cooling by convection therefore takes place while the gas thus warmed up is thereafter sent through a heat exchanger, for example of the water type, which cools the gas before the latter is sent back on the load of articles under treatment.

For a given furnace and load to be treated, the cooling speed of the articles under an atmosphere depends among other factors of the pressure, the recirculation speed and the nature of the gas.

For an existing furnace, the gas speed depends on the recirculating blower. The pressure is controlled by the quantity of gas injected into the furnace; it is limited by the characteristics of the furnace which define a maximum pressure allowable therein.

The gases currently used for hardening are nitrogen and argon. In order to improve cooling speeds without modifying the pressure of the hardening gas or its recirculation speed, it has been proposed to use gases having a better heat conductivity: hydrogen or helium. This promotes heat exchange by convection between the article to be treated and the cooling flow. An improved cooling speed enables to harden a wider range of materials under gas; for a given treatment, it is also possible to decrease the gas pressure in the furnace, thereby lowering the constraints to which the material is subject, or to increase the quantity of material that can be treated during a cycle.

The use of hydrogen which is a flammable gas, requires adequate safety measures on the hardening furnaces. Helium, which is another neutral gas may on the contrary be used instead of nitrogen or argon, without technically modifying the furnace. Because of its high cost, it is still not much in use.

SUMMARY OF THE INVENTION

The technical problem which is at the base of the present invention is the use of helium, or a mixture based on helium, for treatments with gas hardening while remaining economically competitive with known treatments under argon or nitrogen, and this object can be achieved in that at the end of a hardening operation, the load of helium is extracted out of the treatment enclosure, in final phase by pumping until obtaining a primary vacuum, said extracted helium is brought to purifying pressure by means of a compressor associated with a mechanical filter, and said helium is sent under purifying pressure into a purifier for removing impurities, after which it is transferred, possibly after recompression, in the buffer container. In this manner, at the end of the hardening operation, helium, which is polluted with impurities, such as oxygen and water, present in the load or in the furnace, possibly through air leaks and by means of the recovering or recompression material, is recovered after careful purification.

According to a first embodiment, helium is collected at purifying pressure in an intermediate container, after which it is sent into a permeation membrane separator producing purified helium under lower pressure, which is thereafter dried, then sent under pressure by the same compressor toward the buffer container of the furnace.

According to a second embodiment, the extracted helium, recompressed at higher pressure at the holding pressure of the buffer container is mechanically filtered, caused to be transferred into a purifying device for the residual oxygen of the type with controlled addition of hydrogen for catalytic production of water vapor, after which the gas is possibly cooled and dried, then transferred to the said holding container.

According to a third embodiment, the extracted helium, recompressed at a pressure higher than the holding pressure of the buffer container and mechanically filtered is caused to be transferred into a purifying device of the catalytic type for trapping residual oxygen and regenerating the catalyst by means of a flow of hydrogen, after which the gas is possibly cooled and dried and then transferred to said holding container.

According to a fourth embodiment, the extracted helium, recompressed at a pressure higher than the holding pressure of the buffer container and mechanically filtered, is caused to be transferred into a device for purifying residual oxygen and possibly water vapor, of the molecular sieve type, enabling the adsorption of oxygen and possibly water vapor, whose regeneration is ensured by depressurization or by temperature increase, after which the gas is possibly cooled and dried, then transferred into said buffer container.

Normally, the extracted helium, brought to a purifying pressure, is directly and substantially entirely sent into a purifier for removing impurities, possibly after being collected in an intermediate container. It is also possible, for example when the amount of impurities of extracted helium is low, to purify only a fraction of said extracted helium or to purify same only after it has been used for at least two consecutive hardening operations.

The invention also concerns an apparatus for the heat treatment of articles by hardening same in a gaseous medium including at least substantially helium, of the typo comprising a furnace with gas recirculating blower connected by means of ducts including a valve, on the one hand to a buffer container, and on the other hand to a primary vacuum pump bypassed by a duct including a valve and pressure reducer, which is characterized in that it comprises at the outlet of the pump, a small equalization container, a compressor, a mechanical filter, a helium purifier, and possibly, a dryer preferably with water vapor trapping by means of molecular sieve.

The apparatus may, possibly, also comprise a duct, with valves bypassing the helium purifier.

According to an embodiment, the invention provides for the interposition of an intermediate container upstream of the purifier which is of the separator-with-membrane type whose purified gas outlet is connected to a dryer then through a valve upstream of said compressor whose outlet is also and directly connected by means of a valve to the buffer container.

According to another embodiment, the helium purifier is of the type with controlled addition of hydrogen for the catalytic production of water vapor.

According to yet another embodiment, the helium purification is of the type with catalytic withdrawing of the residual oxygen and for regenerating the catalyst with a flow of hydrogen.

The purification of helium can also be of the type with elimination by passage over and adsorption on a molecular sieve of oxygen and possibly of water vapor, the regeneration of said molecular sieves being carried out by depressurization or temperature decrease, possibly accompanied by passage of a flow of pure gas.

BRIEF DESCRIPTION OF THE DRAWINGS

The characteristics and advantages of the invention will in any case appear from the description which follows, by way of example, with reference to the annexed drawings which represent four variants of hardening furnace installations according to the invention.

DESCRIPTION OF THE PREFERRED EMBODIMENTS

Figure 1:
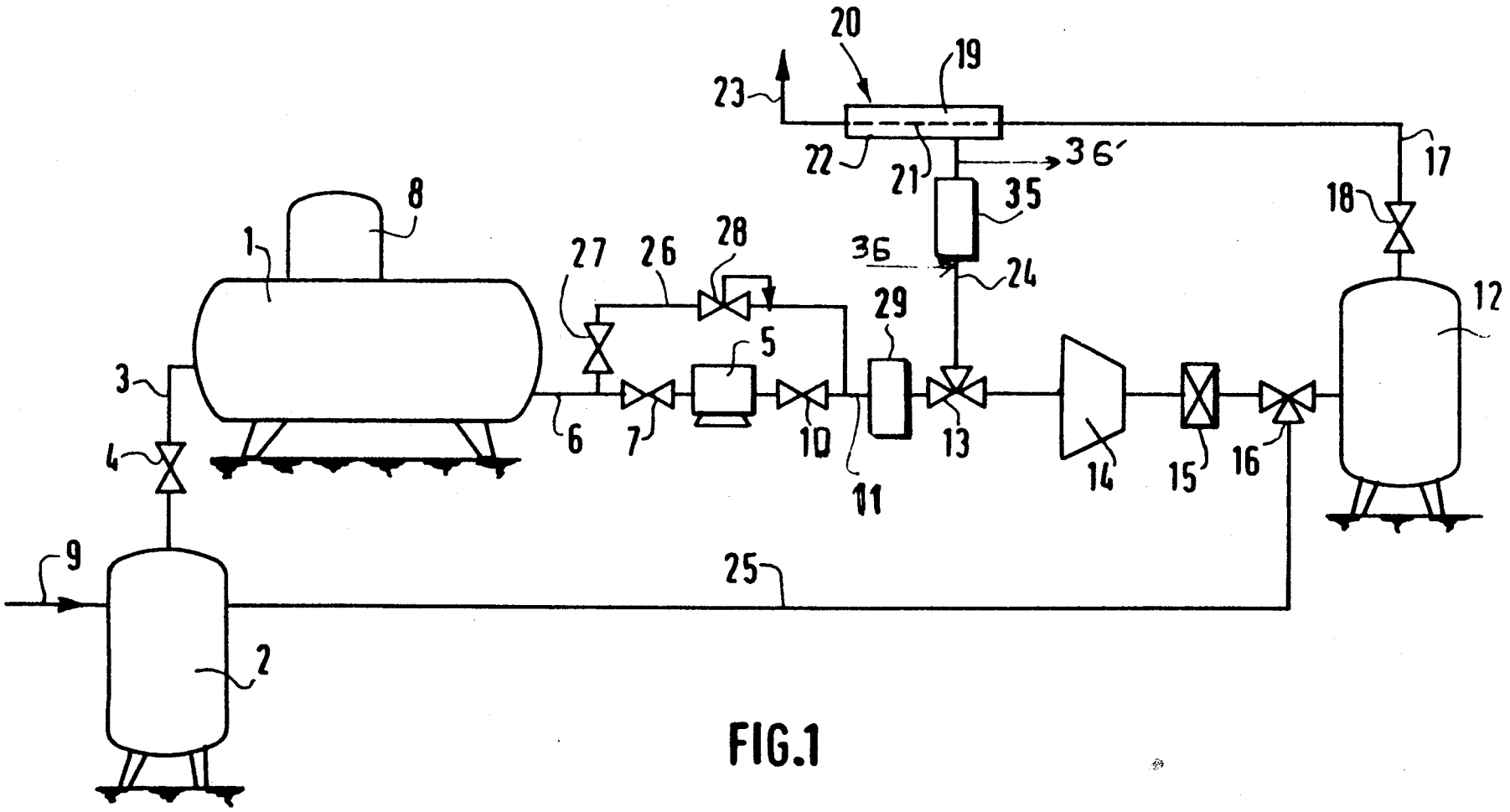
FIG. 1 is a schematic representation of an apparatus according to the invention.

With reference to FIG. 1, a hardening furnace under vacuum 1 is normally connected on the one hand to a buffer container 2 by means of a duct 3 with valve 4, and on the other hand, to a vacuum pump 5, by means of a flushing duct 6 with valve 7. Gaseous hardening is carried out at the end of the temperature rise of the articles in the furnace which is placed under vacuum by means of pump 5 (valve 7 opened), by sudden discharge of the buffer container 2 into furnace 1 by opening valve 4 (valves 7 and 27 closed).

A recirculating blower 8 ensures the homogenization of the atmosphere of the furnace. For a new operation, the buffer container 2 is reloaded at maximum pressure via a loading duct 9.

When used for hardening under helium, according to the invention, the apparatus described above is provided with an equipment for the recovery of helium used towards the end of the hardening operation, which comprises, at the outlet of the flushing pump 5, a connecting duct 11 toward a holding container 12, which successively includes a valve 10 on the discharge of the pump 5, a three way valve 13, compressor 14, an oil removing filter 15, a three way valve 16.

The holding container 12 is connected by means of duct 17 including a valve 18 to the upstream high pressure compartment 19 of a permeator 20 with permeation membrane 21 for separating the latter from a downstream low pressure container 22. The high pressure compartment 19 is connected to a duct 23 for withdrawing impurities, while purified helium reaching downstream low pressure compartment 22 is dried at 35 and must be kept under an intermediate pressure via compressor 14.

On the other hand, three way valve 16 is connected to buffer container 2 by means of duct 25.

Vacuum pump 5 is bypassed by means of a duct 26 including a valve 27 and pressure regulator 28.

The apparatus described operates as follows:

A load of helium is initially introduced into buffer container 2 through duct 9. Hardening takes place in the usual manner by opening valve 4 with introduction, for example until substantial equilibrium, of a portion of the helium stored in buffer container 2 and the hardening operation is carried out with recirculation of helium by means of blower 8 towards an exchanger-cooler (not illustrated).

At the end of the hardening operation, polluted helium is first transferred from furnace 1 towards holding container 12 (valve 27 opened, valves and 10 closed, pump 5 stopped) three way valve 13, compressor 14, oil removing filter 15, three way valve 16 being opened towards holding container 12, where the partially purified helium gas is stored under pressure by means of compressor 14 in operation (valve 18 closed).

As soon as the pressure in the furnace 1 is close to atmospheric pressure, vacuum pump 5 is put into operation (valve 27 closed, valves 7 and 10 opened) with backflow towards compressor 14 which operates as previously indicated. Once a primary vacuum has been achieved in the furnace 1, pump 5 is stopped (valves 7 and 10 closed) and the three way valves 13 and 16 are switched over to their second positions, where they respectively connect downstream compartment 22 of permeator 20 with the inlet of compressor 14 (through valve 13), and the outlet of the oil removing filter with buffer container 2 (through valve 16). The gas purification of helium stored in the holding container 12 can then be carried out by opening valve 18, while the helium purified under low pressure, collected and sent through duct 24 is recompressed by compressor 14 to be stored in buffer container 2. Once this operation is terminated, valve 18 is closed and the three way valves 13 and 16 are switched into their initial positions allowing free passage from furnace 1 towards holding container 12.

Since the buffer container 2 has collected only a portion, which is however quite substantial, of the helium used during the hardening operation, an additional filling is carried out via duct 9 to reach normal operational pressure and a new hardening operation with helium can thereafter be carried out.

According to a variant, when the helium extracted from the furnace contains only a small amount of impurities, it is possible, before the purification step, to reuse helium for one or more hardening operations. For this purpose, at the end of a hardening operation, lightly polluted helium is transferred from furnace 1 through valve 16 which is opened towards buffer container 2, and this is carried out after passage of helium in pump 5, compressor 14 and oil removing filter 15 in the manner indicated above; the helium stored in buffer container 2 may then be reused for a new hardening operation. When helium contains a sufficient amount of impurities, valve 16 is switched so as to enable the apparatus to operate according to the embodiment described above, thereby enabling it to be purified.

EXAMPLE OF OPERATION

The recycling equipment is mounted on a vacuum furnace of inner volume 10 $m^3$ in which treatments of articles of nickel base alloy are carried out. After a plateau at a temperature of 1300° C., a hardening with pure helium at a pressure of 2.5 bar absolute is carried out.

When the treatment is over, the furnace contains cold helium at a pressure of 2.5 bar absolute. Valve 27 is then opened and the gas is expanded at 28 in a circuit which bypasses the primary vacuum pump of the furnace; the gas is thereafter recompressed at 14, filtered and freed from oil at 15, and stored in a holding container 12 at a pressure higher than the buffer container 2 of the furnace. When the gas which is present in the furnace 1 is at atmospheric pressure, valve 27 is closed, valves 7 and 10 are opened; the primary pump 5 is operated and sucks in the gas to send it back at the inlet of the compressor 14. The furnace 1 is thereafter contacted with air, after which it is opened and ready for unloading and reloading.

Helium which is present in the holding container 12 has already been previously filtered and is freed from oil; it is thereafter purified in membrane separator 20, recompressed at 14 and sent back into the buffer container 2 of the furnace. It is sufficient to complete at 9 the quantity of helium lost during the recovery, before starting up another treatment cycle.

Figure 2:
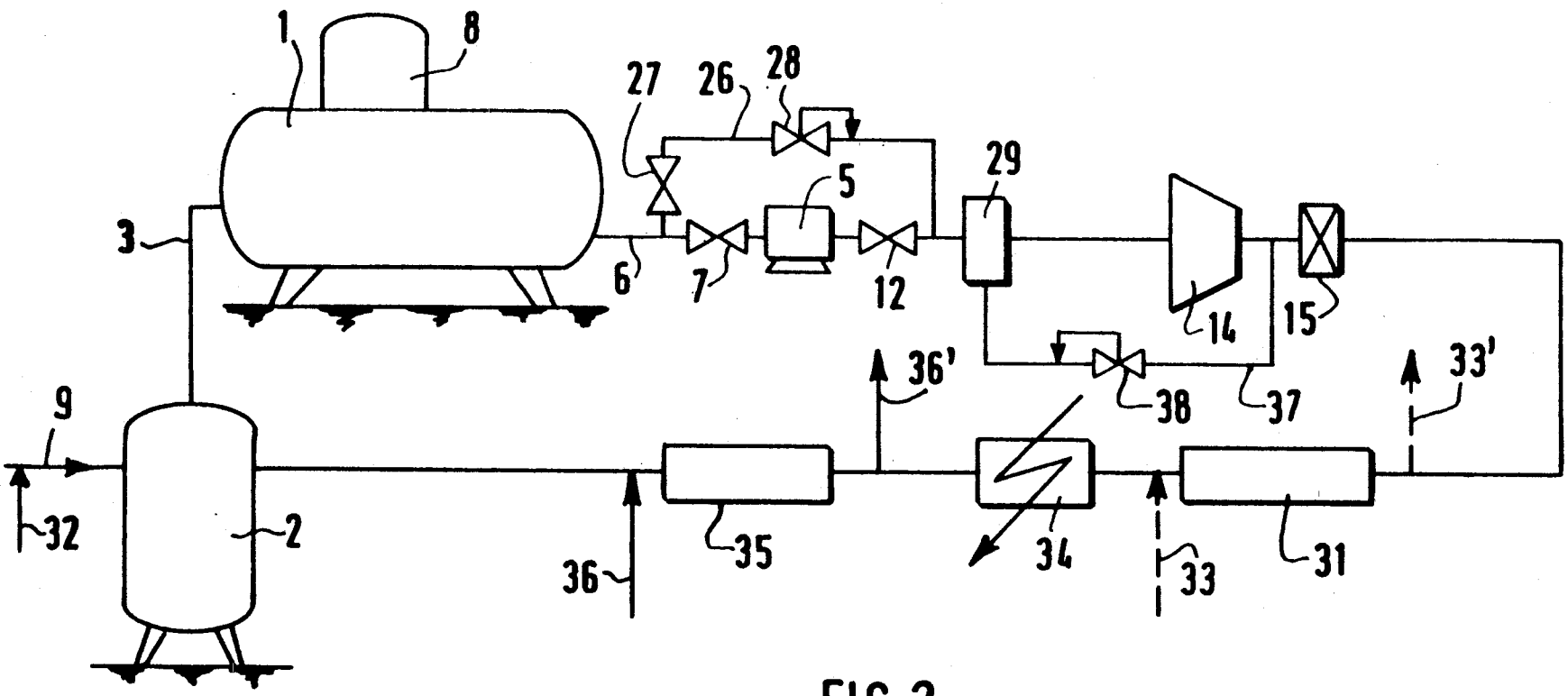
FIG. 2 is a schematic representation of a variant.

With reference to FIG. 2, there is shown a unit consisting of furnace 1, buffer container 2, vacuum pump 5 bypassed by a pressure reducer 28, connected to an equalization container 29. The latter is connected to compressor 14 followed by a mechanical filter 15 and from there, directly to a helium purifier 31. The compressor 14 may possibly be bypassed by means of a duct 37 containing a pressure reducer 38, starting downstream of the compressor 14 and coming back towards the equalization container 29. The helium purifier may be of any one of the following three types:

either an apparatus for removing residual oxygen 31 by reaction with hydrogen added under controlled flow at 32;

or an apparatus for the catalytic removal of oxygen with regeneration with a flow of nitrogen circulating according to 33/33';

or molecular sieves for removing oxygen and water vapor by adsorption.

In the first two cases, it is preferable to rely on a cooler 34 followed by dryer 35 of the type trapping water vapor by means of a molecular sieve and for flushing with a flow of nitrogen 36—36', before reinjection into buffer container 2 under a holding pressure.

In the third case, a cooler 34 may eventually be available. Preferably, at least two molecular sieves mounted in parallel are used, one being in operation and the other being regenerated by depressurization or temperature increase, eventually accompanied by passage of a flow of pure gas.

We claim:

1. In a process for heat treating articles in a furnace by hardening with a recirculating helium-containing hardening gas medium cooled by a heat exchanger and stored under holding pressure in a buffer container, the improvement which comprises: extracting a helium load at the end of the hardening operation by pumping said helium out of the furnace until a primary vacuum is obtained, pressurizing said extracted helium to a purifying pressure with a compressor, mechanically filtering the pressurized helium so as to remove oil impurities, transferring the filtered helium to a purifier for removal of water and oxygen impurities, and recycling the purified helium to said buffer container.

2. Process for heat treating articles according to claim 1, wherein helium under purifying pressure is collected in a intermediate container, after which said helium is sent to a permeation membrane separator producing purified helium under lower pressure, which is thereafter dried and sent back under pressure by said compressor towards the buffer container.

3. Process for heat treating articles according to claim 1, wherein the mechanically filtered helium which is transferred to said purifier, contains residual oxygen, and wherein hydrogen is added to the purifier for the catalytic production of water vapor, after which the purified helium gas is cooled and dried, before recycling to said buffer container.

4. Process for heat treating articles according to claim 1, wherein the mechanically filtered helium which is transferred to said purifier, contains residual oxygen, and wherein said oxygen is catalytically removed in said purifier by means of a catalyst, said catalyst is regenerated by a flow of hydrogen, after which the purified helium gas is cooled and dried, before recycling to said buffer container.

5. Process for heat treating articles according to claim 1, wherein the mechanically filtered helium which is transferred to said purifier, contains residual oxygen and water vapor, and wherein said oxygen and water vapor are adsorbed on a molecular sieve in said purifier, said molecular sieve is regenerated by depressurization or temperature increase accompanied by passage of a flow of pure gas, after which, the purified helium gas is cooled and dried, before recycling to said buffer container.

6. Process for heat treating articles according to claim 1, wherein only a portion of said extracted helium is sent to the purifier for removing impurities.

7. Process for heat treating articles according to claim 1, wherein said extracted helium is sent to the purifier for withdrawing impurities after having been used in at least two consecutive hardening operations.

8. In an apparatus for heat treating articles by hardening in a gas medium including at least substantially helium, of the type comprising a turbine furnace with gas circulation, fluidly connected by means of ducts including valves on the one hand to a buffer container, and on the other hand to a primary vacuum pump which is bypassed by means of a duct including a valve and pressure reducer, the improvement comprising: a small equalization container positioned at the outlet of the pump, a compressor fluidly connected to said equalization container, a mechanical filter fluidly connected to said compressor, and a helium purifier fluidly connected to said mechanical filter.

9. Apparatus for heat treating articles according to claim 8, further including an intermediate reservoir interposed upstream of the purifier, said purifier being of the membrane separator type and having an outlet for purified gas connected by means of a valve upstream of said compressor, said outlet also being connected by means of a valve to the buffer container.

10. Apparatus for heat treating articles according to claim 8, wherein the helium purifier is a reactor for catalytic production of water vapor, and includes means for adding a controlled amount of hydrogen.

11. Apparatus for heat treating articles according to claim 8, wherein the helium purifier is a catalyst-containing reactor for the catalytic removal of residual oxygen, and includes means for adding a flow of hydrogen for the regeneration of catalyst.

12. Apparatus for heat treating articles according to claim 8, wherein the helium purifier is a molecular sieve for the adsorption of oxygen and water vapor, and includes means for regenerating said molecular sieve by depressurization or temperature increase, accompanied by passage of a flow of pure gas.

* * * * *